United States Patent [19]

Ohuchi et al.

[11] Patent Number: 4,984,445

[45] Date of Patent: Jan. 15, 1991

[54] CERAMIC ISOTHERMAL FORGING DIE

[75] Inventors: Kiyoyuki Ohuchi, Tsukuba; Yoshinori Nakazawa, Ibaraki; Kenichi Matsuno, Tsukuba, all of Japan

[73] Assignee: Agency of Industrial Science and Technology, Ministry of International Trade and Industry, Tokyo, Japan

[21] Appl. No.: 508,688

[22] Filed: Apr. 13, 1990

[30] Foreign Application Priority Data

May 18, 1989 [JP] Japan ..... 1-125439

[51] Int. Cl.[5] ..... B21J 13/02

[52] U.S. Cl. ..... 72/360; 72/352; 72/478; 76/107.1

[58] Field of Search ..... 72/352, 354, 357, 360, 72/462, 476, 478; 76/107.1

[56] References Cited

U.S. PATENT DOCUMENTS

| | | | |
|---|---|---|---|
| 2,882,759 | 4/1959 | Altwicker | 72/478 |
| 3,945,240 | 3/1976 | Brown | 72/467 |
| 3,987,658 | 10/1976 | Herold | 72/476 |
| 4,212,189 | 7/1980 | Fuchs et al. | 72/478 |

FOREIGN PATENT DOCUMENTS

| | | | |
|---|---|---|---|
| 0179531 | 10/1983 | Japan | 72/462 |
| 0179532 | 10/1983 | Japan | 72/462 |
| 0205637 | 11/1983 | Japan | 72/462 |

OTHER PUBLICATIONS

Lawrence H. Van Vlack, "Elements of Material Science", 4/1967, pp. 204,222,223, and 224.

*Primary Examiner*—David Jones

*Attorney, Agent, or Firm*—Oblon, Spivak, McClelland, Maier & Neustadt

[57] ABSTRACT

A ceramic isothermal forging die comprises a pair of disk-shaped die halves that are formed of ceramic and have die cavities cut in their mating surfaces and a pair of die half holders each having a recess for accommodating one of the die halves. Each die half is divided into a plurality of radial segments whose bottom surfaces are tapered away from their mating surface with increasing proximity to the center of the die. The floor of each die half holder is tapered to become deeper toward the center of the die and to be complementary to the tapered bottom surfaces of the die segments. The ceramic material of the die makes it usable in the atmosphere. Because of the segmentation of the die halves and the tapering of the segment bottoms and the floor of the die holder recesses, a large force which would otherwise be produced in the circumferential direction of the die by thermal stress during heating and cooling is suppressed. Further, a force urging the segments toward the center of the die is produced during forging. As a result, that die is protected from breakage and from disintegration by separation of the segments.

5 Claims, 1 Drawing Sheet

CERAMIC ISOTHERMAL FORGING DIE

BACKGROUND OF THE INVENTION

1. Field of the Invention

This invention relates to an isothermal forging die formed of ceramic and more particularly to a ceramic isothermal die suitable for being heated to and maintained at the forging temperature of a heat resistant metal such as a titanium alloy or a nickel-based alloy during the period that the metal is being forged.

2. Prior Art Statement

Most metallic materials having great high-temperature strength such as titanium and nickel-based alloys are characteristically difficult to process. One effective way of processing such materials is by the isothermal forging method in which the forging die is heated to the forging temperature of the metal concerned (to 900° C. in the case of a titanium alloy and to 1050° C. in the case of a nickel-based alloy).

Conventionally such isothermal forging has been carried out using a die made of a molybdenum alloy exhibiting a high coefficient of thermal conductivity. In the atmosphere, the molybdenum alloy oxidizes at temperatures over 300° C. and at temperatures exceeding 600° C. the oxides vaporize, much in the manner of sublimation. Because of this, the forging has been carried out in a protective atmosphere or a vacuum, making it necessary to use a huge chamber capable of accommodating the forging equipment and the like.

The inventors therefore considered ceramic material as a possible replacement for the molybdenum alloy of the die. Use of a ceramic die would enable the forging operation to be conducted in the atmosphere and, as a result, would make isothermal forging more generally usable. To this end, the inventors conducted experiments and pursued various avenues of research in connection with ceramic materials. However, they found that practical application was beset with numerous problems relating to thermal stress and the like.

Most isothermal dies are disk-shaped and are generally constituted of two disk-shaped die halves whose mating surfaces have been formed with die cavities At the time of isothermal forging, the two die halves are mated with the workpiece to be forged sandwiched between them and the result is loaded into a forging press and heated. The heating thus proceeds from the periphery not formed with a die cavity. Where the die is formed of ceramic, the generally low coefficient of thermal conductivity of this material tends to cause a steep temperature gradient at the time of heating and cooling. As a result, when the die is heated or cooled from its periphery, a large temperature gradient occurs in the radial direction and this produces a large thermal stress in the ceramic material. When this stress becomes greater than what the ceramic can stand, the ceramic breaks, making the die unserviceable. This phenomenon is dominated by the temperature difference in the die, particularly that in the radial direction, and tends to occur mainly at the start of heating and cooling.

For using ceramic as a material for a forging die, therefore, it is necessary to provide the die with a structure which enables it to avoid excessively large stress and, simultaneously, to bear up under the forging load.

In view of the foregoing, the object of the present invention is to provide a ceramic isothermal forging die which suppresses the occurrence of excessive stress due to large temperature gradient and can be used for isothermal forging not only in a vacuum or protective atmosphere but also in the atmosphere.

OBJECT AND SUMMARY OF THE INVENTION

For achieving this purpose, the present invention provides a ceramic isothermal forging die comprising a pair of disk-shaped die halves having die cavities cut into their mating surfaces, each die half being constituted of a plurality of radial die segments whose bottom surfaces are tapered away from their mating surfaces toward the die center, and a pair of die half holders for holding the die halves, the die half holders each having a die half supporting surface tapered to be complementary to the taper of the die segments of the die half held therein The division of the disk-shaped ceramic die halves into a plurality of radial segments or wedges serves to alleviate the large tensile stress produced in the circumferential direction when a sharp temperature gradient arises in the die half during heating or cooling. It thus helps to prevent the die from breaking However, if the segmented die halves should be used as they are, they would be liable to shift during forging, causing the die to disintegrate. It would thus be difficult to carry out the forging operation. While it might be thought that this problem could be avoided by clamping the periphery of the die halves with a ring for preventing shifting of the die segments, this is not practical since, more likely than not, the ring itself would break.

In this invention, therefore, the bottom surfaces of the die segments are tapered away from their mating surfaces toward the die center and the die half supporting surfaces of the die half holders are tapered in a manner complementary to the tapered bottom surfaces of the segments. With this arrangement, when the die is used for forging, a force urging the die segments toward the die center is produced to act against the force tending to cause die disintegration. There is thus realized a die which is safe from disintegration and which can be used in the atmosphere for forging of heat resistant metals materials.

DETAILED DESCRIPTION OF THE PREFERRED EMBODIMENT

Figure 1:
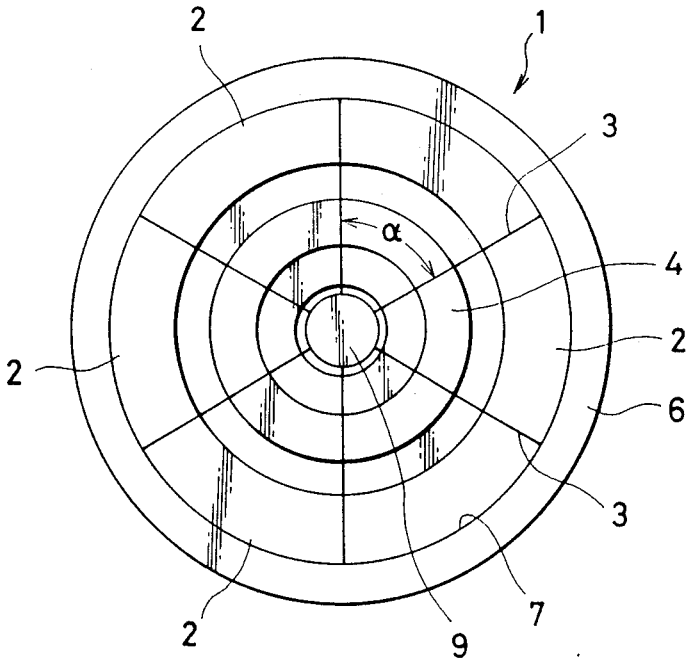
FIG. 1 is a plan view of an embodiment of the ceramic isothermal forging die in accordance with this invention.
Figure 2:
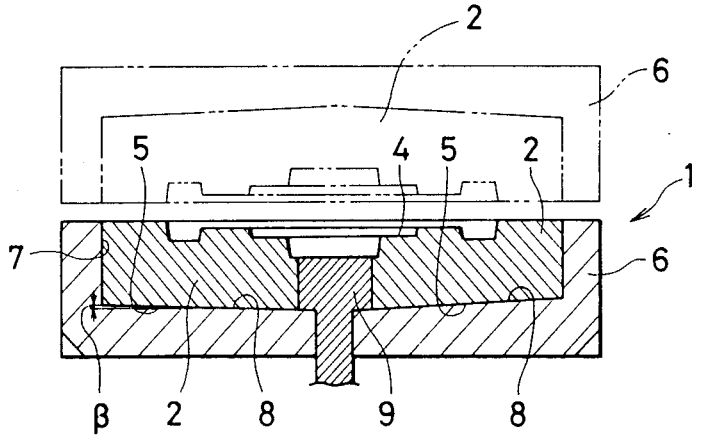
FIG. 2 is a vertical sectional view of the forging die of FIG. 1.

FIGS. 1 and 2 show an embodiment of a ceramic isothermal forging die according to this invention, which is intended for use in isothermal of jet engine turbine disks and the like from titanium alloy, nickel-based alloy and other such heat resistant metals. It is constituted of a die 1 made up of a pair of disk-shaped die halves having die cavities cut into their mating surfaces and a pair of die half holders 6, 6 for accommodating the die halves. Each of the die halves is divided into a plurality of die segments 2 by a plurality of slits 3. The bottom surface 5 of each die segment 2 is tapered away from its mating surface in the direction of the die center.

Each die half holder 6 is formed with a recess 7 for accommodating one of the die halves. The floor 8 of each recess 7 is tapered to become deeper toward the center of the die in such manner as to be complementary to the tapered bottom surface 5 of die segments 2 to be accommodated in its recess 7. Reference numeral 9 in FIG. 2 indicates a knockout put.

The segments 2 of each die half are formed by molding powdered ceramic material into an appropriately shaped mass, sintering the mass to obtain a ceramic block, discharge machining the ceramic block into a disk, cutting an appropriate die cavity in the disk, cutting the disk into radial segments by discharge machining, and polishing the cut surfaces to a mirror finish. As the ceramic material it is preferable to use Sialon or some other electrically conductive ceramic material as this makes it possible to use discharge machining for carrying out complex diesinking with relative ease.

While the number of radial segments 2 formed by the radial slits 3 must be at least two, the actual number can be selected as required for the specific application In the case of a large die or where it is desired to heat and cool the die rapidly, it is necessary to increase the number of the segments so as to reduce the size of each, e.g. to six as illustrated in FIG. 2, thereby effectively achieving the desire. There is no particular need for all of the segments 2 to have the same apex angle $\alpha$, and there may be differences among the apex angles $\alpha$ of the different segments 2.

The taper angle $\beta$ of the tapered bottom surface of each die segment and the tapered floor 8 of each die half holder 6 is ordinarily about 5° but a larger or smaller angle can also be adopted insofar as a force urging the die segments toward the center can be obtained The die half holders 6 are formed of a metal with superior high-temperature strength Nicklel-based alloys are one example and are advantageous since their good resistance to oxidation makes it possible to carry out the isothermal forging in the atmosphere.

When the portion of the ceramic isothermal forging die that is subject to great stress is formed by arranging a plurality of segments 2 in this way, the large tensile stress in the circumferential direction that is caused by the temperature gradient during heating and cooling is suppressed, whereby the die 1 can be protected from breakage.

However, if the segments 2 of the die halves should be used as they are, they would be likely to be shifted radially outward by the flow of the material being forged during forging and this could well lead to disintegration of the die. Moreover, an attempt to prevent shifting of the segments 2 merely by the peripheral portion of the die half holders 6 or by some other ring-shaped member would fail because of the high probability that the retaining member itself would break As explained above, in this invention, therefore, the bottom surfaces 5 of the segments 5 is tapered and these tapered bottom surfaces are supported on the tapered floors 8 of the die half holders 6. This arrangement results in the production of a force during forging that acts on the segments 2 of the respective die halves in a direction opposite from the force which tends to separate the segments 2. As a result, disintegration of the die is prevented and intimate contact between adjacent segments in the circumferential direction is promoted, whereby the formation of burs that might otherwise occur because of the segmentation of the die 1 is minimized.

When the ceramic isothermal forging die according to this invention is used for isothermal forging, the forging can be conducted not only in a vacuum or a protective atmosphere but also in the atmosphere.

As has been explained in the foregoing, by the simple expedient of dividing a die into a plurality of segments this invention makes it possible to obtain a ceramic isothermal forging die capable of avoiding production of great stress in the die as a result of a temperature gradient therein. Moreover, since the bottom surface of the segments is tapered and the tapered bottom surfaces of the segments are supported on the tapered floors of the die half holders, a force urging the segments toward the die center is produced during forging so that disintegration of the die is prevented.

Since the die can therefore be used for forging operations conducted in the atmosphere, it makes isothermal forging easy to use in wide-ranging applications.

What is claimed is:

1. A ceramic isothermal forging die comprising a pair of disk-shaped die halves formed of ceramic and having die cavities formed in mating surfaces thereof and a pair of die half holders each having a recess for accommodating one of the die halves, each die half being divided into a plurality of radial segments having a bottom surface tapered away from its mating surface toward a center of the die, the recess of each die half holder having a floor tapered to become deeper toward the center of the die in such manner as to be complementary to the tapered bottom surfaces of the die segments.

2. A forging die according to claim 1 wherein the ceramic is electrically conductive.

3. A forging die according to claim 2 wherein the electrically conductive ceramic is Sialon.

4. A forging die according to claim 1 wherein the apex angle of the segments is 60°.

5. A forging die according to claim 1 wherein the taper angle of the bottom surfaces of the segments is 5°.

* * * * *